US006354027B1

(12) United States Patent
Cummings

(10) Patent No.: US 6,354,027 B1
(45) Date of Patent: Mar. 12, 2002

(54) FILE/BOOK PLACE MARKER SYSTEM

(76) Inventor: Andrea Cummings, 518 Gregory, Chicago Heights, IL (US) 60411

( * ) Notice: Subject to any disclaimer, the term of this patent is extended or adjusted under 35 U.S.C. 154(b) by 0 days.

(21) Appl. No.: 09/614,281

(22) Filed: Jul. 12, 2000

(51) Int. Cl.[7] ..... B42F 21/00
(52) U.S. Cl. ..... 40/359
(58) Field of Search ..... 40/359, 666, 641, 40/673, 617, 600, 360, 584; 312/183, 184, 187, 189, 348.3, 348.5; D19/32; 283/37; 206/371

(56) References Cited

U.S. PATENT DOCUMENTS 3,090,347 A * 5/1963 Harnett, Jr. ..... D19/34 X
4,722,145 A * 2/1988 Prest ..... 40/584
D331,598 S * 12/1992 Martin ..... D19/32
5,664,673 A * 9/1997 Perry ..... 206/371
5,676,439 A * 10/1997 Occhipinti et al. ..... 312/183
5,836,098 A * 11/1998 Carney ..... 40/666

* cited by examiner

*Primary Examiner*—Robert J. Oberleitner
*Assistant Examiner*—Melanie Torres
(74) *Attorney, Agent, or Firm*—Joseph N. Breaux

(57) ABSTRACT

A system for identifying the location of a file or book removed from a file cabinet or book shelf. The system includes a T-shaped marker member having a flexible plastic erasable top surface portion for receiving thereon a book/file borrower's name, dept. etc. and a hard plastic bottom surface portion for supporting the top surface portion; a storage hook assembly including a marker member attachment hook, a writing instrument storage holder and a hook assembly attachment mechanism for attaching the storage hook assembly in a convenient location adjacent to a file cabinet or book shelf; and an erasable marker sized to snap fit into the writing instrument storage holder.

3 Claims, 4 Drawing Sheets

FILE/BOOK PLACE MARKER SYSTEM

TECHNICAL FIELD

The present invention relates to office systems and more particularly to a file/book place marker system including a T-shaped marker member having a flexible plastic erasable top surface portion for receiving thereon a book/file borrower's name, dept. etc. and a hard plastic bottom surface portion for supporting the top surface portion; a storage hook assembly including a marker member attachment hook, a writing instrument storage holder and a hook assembly attachment mechanism for attaching the storage hook assembly in a convenient location adjacent to a file cabinet or book shelf; and an erasable marker sized to snap fit into the writing instrument storage holder.

BACKGROUND ART

Offices and other organizations typically maintain records and reference libraries that are used by many individuals within the organization. Because more than one individual may need to access the book or file at the same time, it would be a benefit to have a system whereby a marker could be positioned in the file or bookshelf location where the file or book is maintained that included identifying information on the borrower so that the other individual could contact the person with the file or book to ascertain its availability. Because books and files are often returned after a short period of time, it would be a further benefit to have a marker wherein the borrower's identifying information could be erased and a new borrower's identifying information place thereon for the next use of the marker. When the marker is not being used, it would be a further benefit to have a holding bracket that could hold the marker(s) in a convenient location along with a marker pen for writing on the marker.

GENERAL SUMMARY DISCUSSION OF INVENTION

It is thus an object of the invention to provide a file/book place marker system that includes a T-shaped marker member having a flexible plastic erasable top surface portion for receiving thereon a book/file borrower's name, dept. etc. and a hard plastic bottom surface portion for supporting the top surface portion; a storage hook assembly including a marker member attachment hook, a writing instrument storage holder and a hook assembly attachment mechanism for attaching the storage hook assembly in a convenient location adjacent to a file cabinet or book shelf; and an erasable marker sized to snap fit into the writing instrument storage holder.

Accordingly, a file/book place marker system is provided. The file/book place marker system includes a T-shaped marker member having a flexible plastic erasable top surface portion for receiving thereon a book/file borrower's name, dept. etc. and a hard plastic bottom surface portion for supporting the top surface portion; a storage hook assembly including a marker member attachment hook, a writing instrument storage holder and a hook assembly attachment mechanism for attaching the storage hook assembly in a convenient location adjacent to a file cabinet or book shelf; and an erasable marker sized to snap fit into the writing instrument storage holder.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
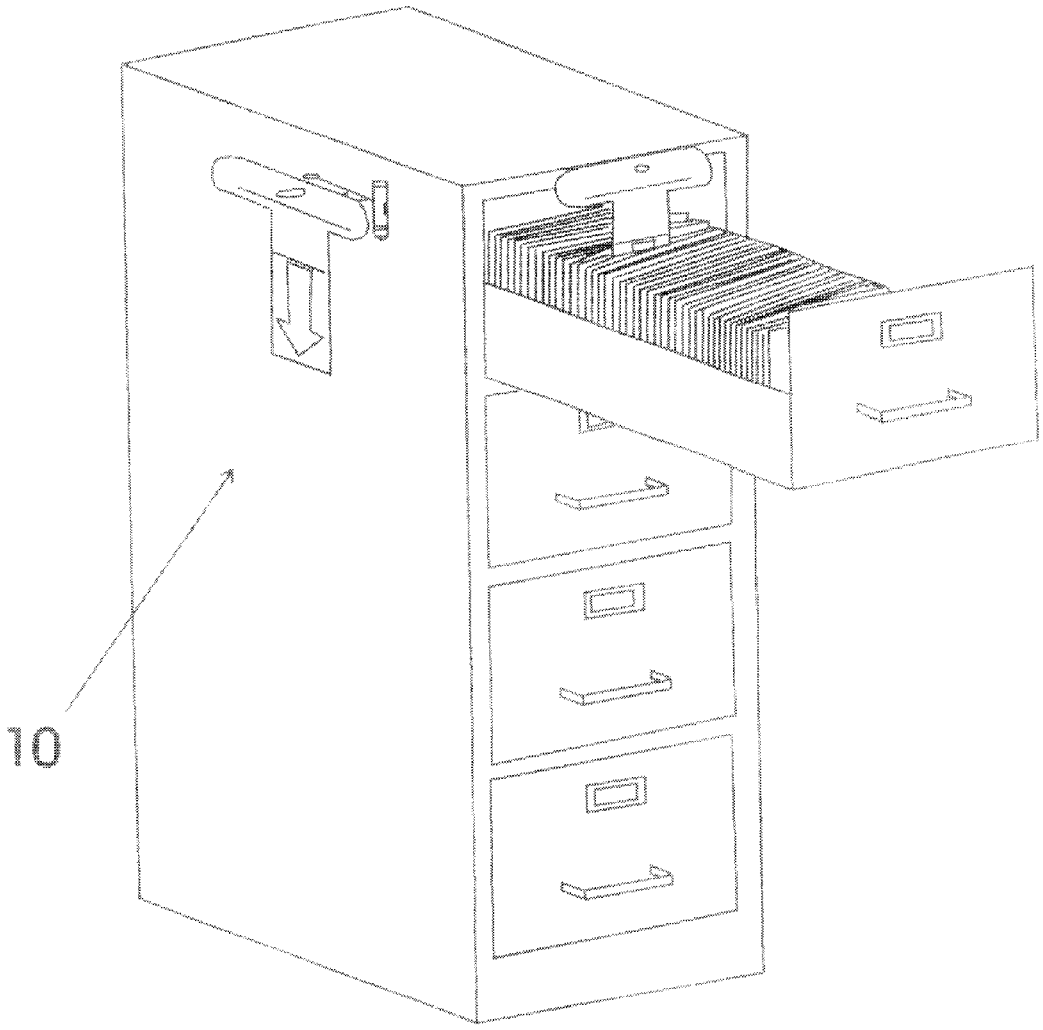
FIG. 1 is a perspective view of an exemplary embodiment of the file/book place marker system of the present invention in use with a representative file cabinet.
Figure 2:
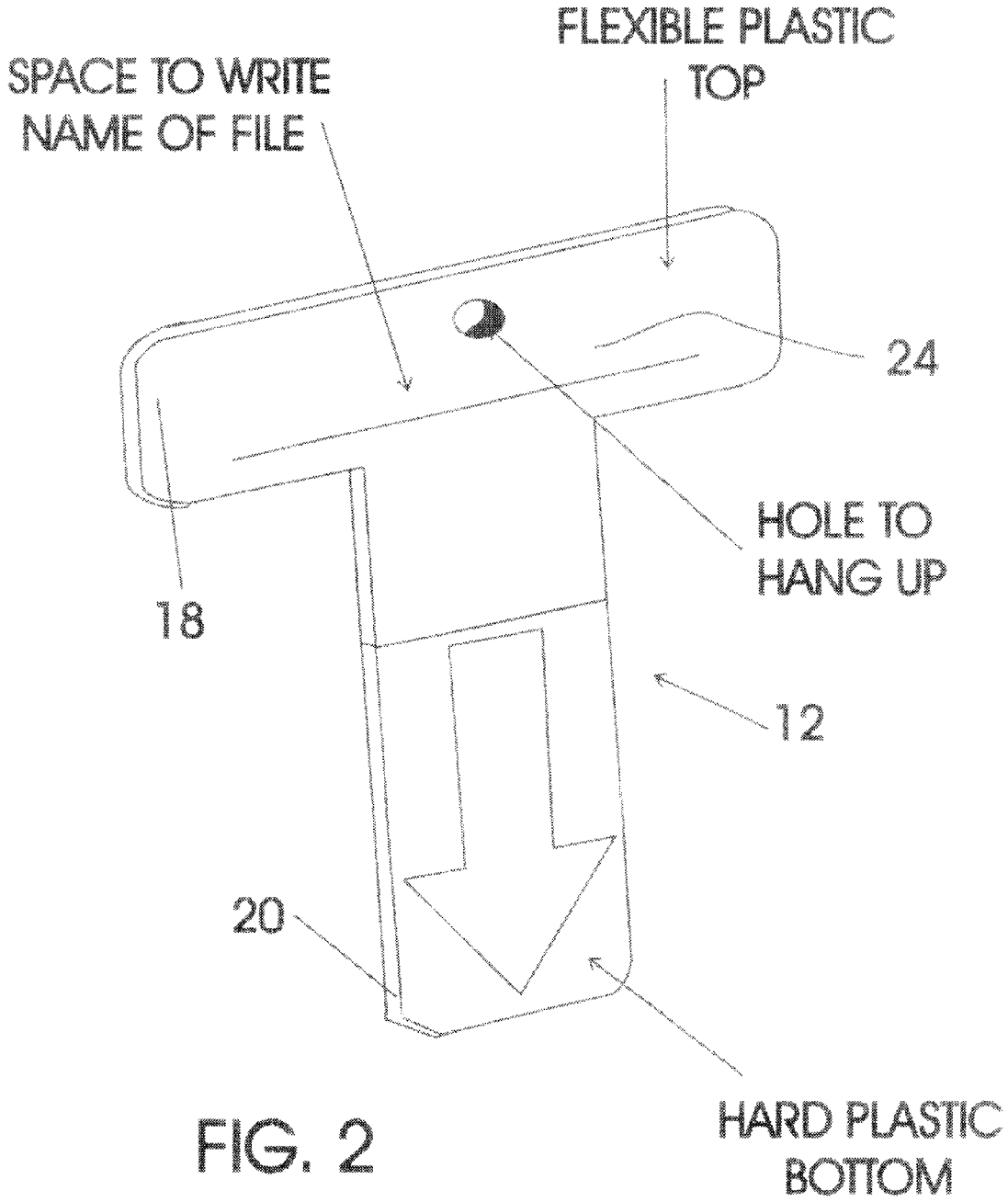
FIG. 2 is a perspective view of one of the T-shaped marker members in isolation showing the flexible plastic erasable top surface portion with the attachment hole formed therethrough and the writing surface provided thereon for receiving thereon a book/file borrower's name, dept. etc. and a hard plastic bottom surface portion for supporting the top surface portion.
Figure 3:
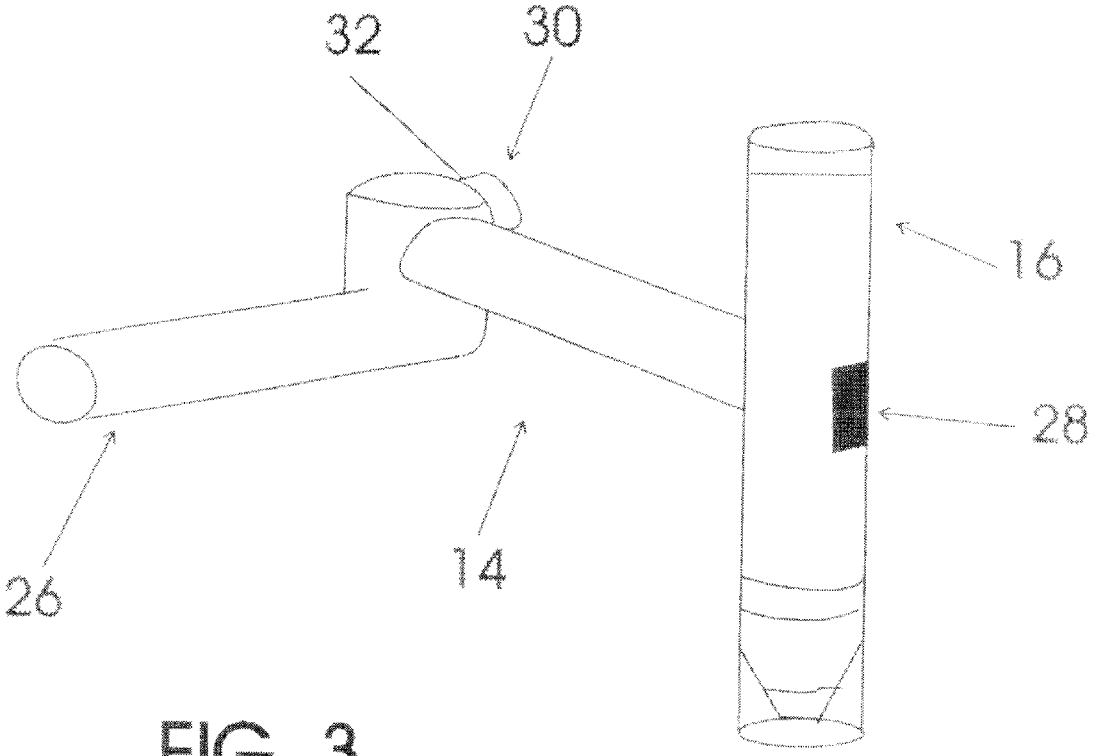
FIG. 3 is a perspective view of a first exemplary embodiment of the storage hook assembly showing the marker member attachment hook, the writing instrument storage holder and the magnetic hook assembly attachment mechanism; also show is the erasable marker sized to snap fit into the writing instrument storage holder.
Figure 4:
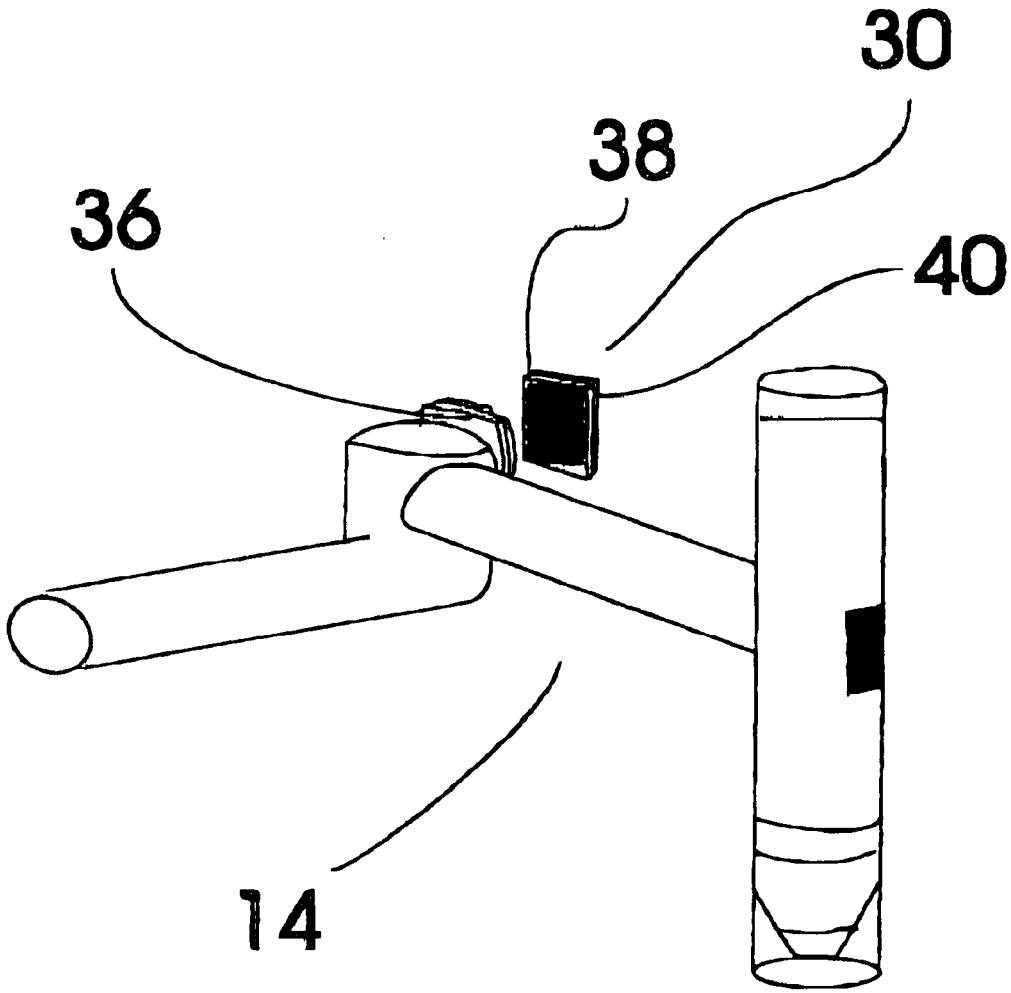
FIG. 4 is a perspective view of a second exemplary embodiment of the storage hook assembly showing the marker member attachment hook, the writing instrument storage holder and a hook and pile attachment mechanism used in place of the magnetic hook assembly attachment mechanism of FIGS. 1 and 3.

FIGS. 1–4 show various aspects of exemplary embodiments of the file/book place marker system of the present invention generally designated 10. File/book place marker system 10 includes two T-shaped marker members, generally designated 12; a molded plastic storage hook assembly, generally designated 14; and an erasable marker, generally designated 16.

T-shaped marker member 12 has a flexible plastic erasable top surface portion 18 and a hard plastic bottom portion 20. Flexible plastic erasable top surface portion 18 has a hole 22 formed therethrough for connection with the storage hook assembly 14 and an erasable writing surface 24 upon which the user writes identifying information with erasable marker 16 so that a person looking for a particular file or book can identify who has the file or book. Hard plastic bottom surface portion 20 is sufficiently rigid to support top surface portion 18 in an upright position.

Storage hook assembly 14 is constructed from molded plastic and includes a marker member attachment hook, generally designated 26; a writing instrument storage holder, generally designated 28; and a hook assembly attachment mechanism, generally designated 30. In the embodiment shown in FIG. 3, hook assembly attachment mechanism 30 is a magnet 32 for attaching storage hook assembly 14 to the side of a metal file cabinet. In the embodiment shown in FIG. 4, hook assembly attachment mechanism 30 includes first and second section 36,38 of companionate hook and pile fastener material. Section 36 is permanently attached to storage hook assembly 14. Section 38 is provided with a layer of adhesive 40 on a back surface thereof for securing to a structure such as a book shelf or the side of a file cabinet.

It can be seen from the preceding description that a file/book place marker system has been provided.

It is noted that the embodiment of the file/book place marker system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A file/book place marker system comprising:

a T-shaped marker member having a flexible plastic erasable top surface portion for receiving thereon descriptive indicia and a hard plastic bottom surface portion for supporting said top surface portion;

a storage hook assembly including a marker member attachment hook, a writing instrument storage holder and a hook assembly attachment mechanism for attaching said storage hook assembly in a convenient location adjacent to a file cabinet or book shelf; and an erasable marker sized to snap fit into said writing instrument storage holder.

2. The file/book place marker system of claim 1 wherein:

said hook assembly attachment mechanism is a magnet.

3. The file/book place marker system of claim 1 wherein:

said hook assembly attachment mechanism includes a first section of hook and pile material secured to said hook assembly and a second section of hook and pile material companionate with said first section of hook and pile material having an adhesive covered back for securing said second section to a convenient location near a use location.

* * * * *